US005488910A

United States Patent [19]

Pees et al.

[11] Patent Number: 5,488,910

[45] Date of Patent: Feb. 6, 1996

[54] UNDERCARRIAGE FOR RAILWAY CAR

[75] Inventors: Ernst Pees, Altenholz; Hans-Dieter Schaller, Kiel, both of Germany

[73] Assignee: Krupp Verkehrstechnik GmbH, Kiel, Germany

[21] Appl. No.: 179,929

[22] Filed: Jan. 11, 1994

[51] Int. Cl.[6] ..... B61F 5/38

[52] U.S. Cl. ..... 105/166; 105/168

[58] Field of Search ..... 105/166, 167, 105/168, 195, 196

[56] References Cited

U.S. PATENT DOCUMENTS

| | | | |
|---|---|---|---|
| 4,519,329 | 5/1985 | Vacher | 105/168 |
| 4,679,507 | 7/1987 | Rassaian | 105/166 X |
| 5,263,420 | 11/1993 | Schwendt et al. | 105/166 |

FOREIGN PATENT DOCUMENTS

| | | | |
|---|---|---|---|
| 743303 | 3/1933 | France | 105/168 |
| 3258656 | 11/1991 | Japan | 105/168 |
| 1571499 | 7/1980 | United Kingdom | 105/168 |

*Primary Examiner*—Robert J. Oberleitner
*Assistant Examiner*—Kevin D. Rutherford
*Attorney, Agent, or Firm*—Thomas N. Ljungman

[57] ABSTRACT

On truck frames having three wheelsets, the invention teaches that the middle wheelset is in contact on each side with the vehicle frame by means of actuators in the lateral direction. These actuators are used to adjust the middle wheelset when the train travels through curves toward the outside of the curve, as a function of the angle of rotation of the truck frame, which is determined by means of measurement elements.

19 Claims, 6 Drawing Sheets

UNDERCARRIAGE FOR RAILWAY CAR

BACKGROUND OF THE INVENTION

1. Field of the Invention

This invention relates to a running gear for railway vehicles having at least six wheelsets, or pairs of wheels, whereby arrangements of three wheelsets can be connected by means of coupling and guide elements, in particular for longitudinal and lateral guidance, to a truck frame. The truck frames can each turn rotate, or pivot, in relation to a vehicle frame.

2. Background Information

One problem with the configuration described above is that the ability of railway vehicles having three-axle trucks to take curves is largely determined by the middle wheelsets of the trucks, and the middle wheelsets in known realizations tend to the inside of the curve in a small radius curve. A lateral force is generated between the inside wheel and the rail, which presses the wheelset toward the outside of the curve and, in connection with tapered wheel profiles, generates a moment of force opposite to the direction of rotation of the curve.

The force and moment, compared to a freewheeling of the middle wheelset, thereby cause an increase in the level of the wheel-rail forces on the terminal axles, that is, the two axles corresponding to the wheelsets other than the middle wheelset.

To improve the curve compliance of railway vehicles having three-axle trucks, known devices include running gear in which the middle wheelset of each truck is installed so that it has sufficient lateral play in relation to the truck frame. In this manner, the middle wheelset can essentially be freely adjusted when the vehicle enters a curve having a small radius of curvature, on account of the absence of restoring forces between the wheelset and the truck frame in the lateral direction. The curve compliance of such railway vehicles is thus similar to the behavior of railway vehicles having two-axle trucks and a wheelbase which corresponds to the distance between the two terminal axles of the three-axle trucks.

Such designs have the disadvantage that when the train is travelling through a curve with an excess of centrifugal force, the middle wheelset tends not to participate in the transmission of the centrifugal forces from the vehicle body and the truck frame to the rail, and thereby increases the proportion of such forces which must be transmitted by the terminal wheelsets of the trucks. This can lead to unacceptably high rail displacement forces, in particular when the vehicle travels through curves at high speeds.

OBJECT OF THE INVENTION

The object of the invention is to create a running gear of the type described above in the "Background of the Invention" section which improves the curve compliance and minimizes the load on the rail, even when there are rather large differences in camber to be overcome.

SUMMARY OF THE INVENTION

The invention teaches that the above object can be achieved by placing a force-controlled actuator, which acts in the lateral direction, on each side of the middle wheelset, between the truck frame and the middle wheelset. Also, to adjust the middle wheelset on curves towards the outside of the curve, the force-controlled actuator can be set by means of a control unit, as a function of a measurement element which measures the angle of rotation of the truck frame.

As a result of this configuration, it is possible to move the middle wheelset into an optimal position for the curve in question, with regard to the load on the rail and the distribution of forces among the individual wheelsets. When a railway vehicle equipped in this manner travels through a curve, the actuator is preferably actuated toward the outside of the curve, so that the middle wheelset is moved away from the rail on the inside of the curve.

If there is a significant excess amount of centrifugal force, the force acting in the actuators and the corresponding distance can be adjusted within the limits represented by the possible relative distance between the wheelset and the truck frame.

In one advantageous configuration, there can preferably be a sensor which acts as a measurement element and is located between the vehicle frame and the truck frame, whereby the actuators can be adjusted as a function of the angle of rotation measured by the sensor.

The invention also teaches that the actuators can also be formed so that they exert a specified prestress for the lateral guidance of the wheelset.

The invention also teaches that there can be a sensor on each truck frame, and the actuators can all be adjusted jointly by the control unit as a function of the average value of the two angles of rotation. The particular advantage of this configuration is that the radius of the curve being negotiated can be determined very precisely from the average angle of rotation.

In one simple configuration, the actuators are designed as bellows-type air spring cylinders.

In summary, one aspect of the invention resides broadly in a railroad bogie for being mounted on a railroad car, the railroad car having a frame and defining a longitudinal direction parallel to a direction of travel of the railroad car and a lateral direction perpendicular to the longitudinal direction, the railroad car for being displaced on a railroad track, the railroad bogie comprising: a frame element; means for pivotally connecting the frame element to the frame of the railroad car; a first wheelset being mounted on the frame element; a second wheelset being mounted on the frame element; a third wheelset being mounted on the frame element; the third wheelset being mounted on the frame element between the first wheelset and the second wheelset; the third wheelset comprising: an axle, the axle comprising opposite ends; and a pair of wheels being mounted at the opposite ends of the axle; means for adjusting a position, in a direction parallel to the lateral direction of the railroad car, of the axle of the third wheelset with respect to the frame element during travel of the railroad car through a curved portion of railroad track, the curved portion of track having an outer rail and an inner rail, the outer rail being disposed away from a radial center of the curved portion of track and the inner rail being disposed towards the radial center of the curved portion of track; and the lateral adjusting means comprising means for laterally displacing the axle of the third wheelset in a direction towards the outer rail of the curved portion of track.

Another aspect of the invention resides broadly in a railroad bogie for being mounted on a railroad car, the railroad car having a frame and defining a longitudinal direction parallel to a direction of travel of the railroad car and a lateral direction perpendicular to the longitudinal direction, the railroad car for being displaced on a railroad track, the railroad bogie comprising: a frame element; means for pivotally connecting the frame element to the frame of the railroad car; at least one wheelset being mounted on the frame element; each the at least one wheelset comprising: an axle, the axle comprising opposite ends; and a pair of wheels being mounted at the opposite ends of the first axle; and means for adjusting a position, in a direction parallel to the lateral direction of the railroad car, of the axle of at least one of the at least one wheelset with respect to the frame element during travel.

Yet another aspect of the invention resides broadly in a method of operating a railroad bogie on a railroad car, the railroad car having a frame and defining a longitudinal direction parallel to a direction of travel of the railroad car and a lateral direction perpendicular to the longitudinal direction the railroad car for being displaced on a railroad track, the method comprising the steps of: providing a frame element; providing means for pivotally connecting the frame element to the frame of the railroad car; providing at least one wheelset and mounting the at least one wheelset on the frame element, each of the at least one wheelset comprising an axle, the axle comprising opposite ends, each of the at least one wheelset comprising a pair of wheels being mounted at the opposite ends of the axle; providing means for adjusting, in a direction parallel to the lateral direction of the railroad car, a position of at least one of the at least one wheelset with respect to the frame element during travel; providing means for sensing an angular position of the frame element with respect to the frame of the railroad car; providing means for determining a revised lateral position of the at least one of the at least one wheelset with respect to the frame element based on the angular position of the frame element with respect to the frame of the railroad car; sensing an angular position of the frame element with respect to the frame of the railroad car; determining a revised lateral position of the at least one of the at least one wheelset with respect to the frame element based on the angular position of the frame element with respect to the frame of the railroad car; and adjusting, in a direction parallel to the lateral direction of the railroad car, the position of the axle of each of the at least one wheelset during travel.

BRIEF DESCRIPTION OF THE DRAWINGS

Embodiments of the invention are illustrated schematically in the accompanying drawings, wherein.

DESCRIPTION OF THE PREFERRED EMBODIMENTS

Figure 1:
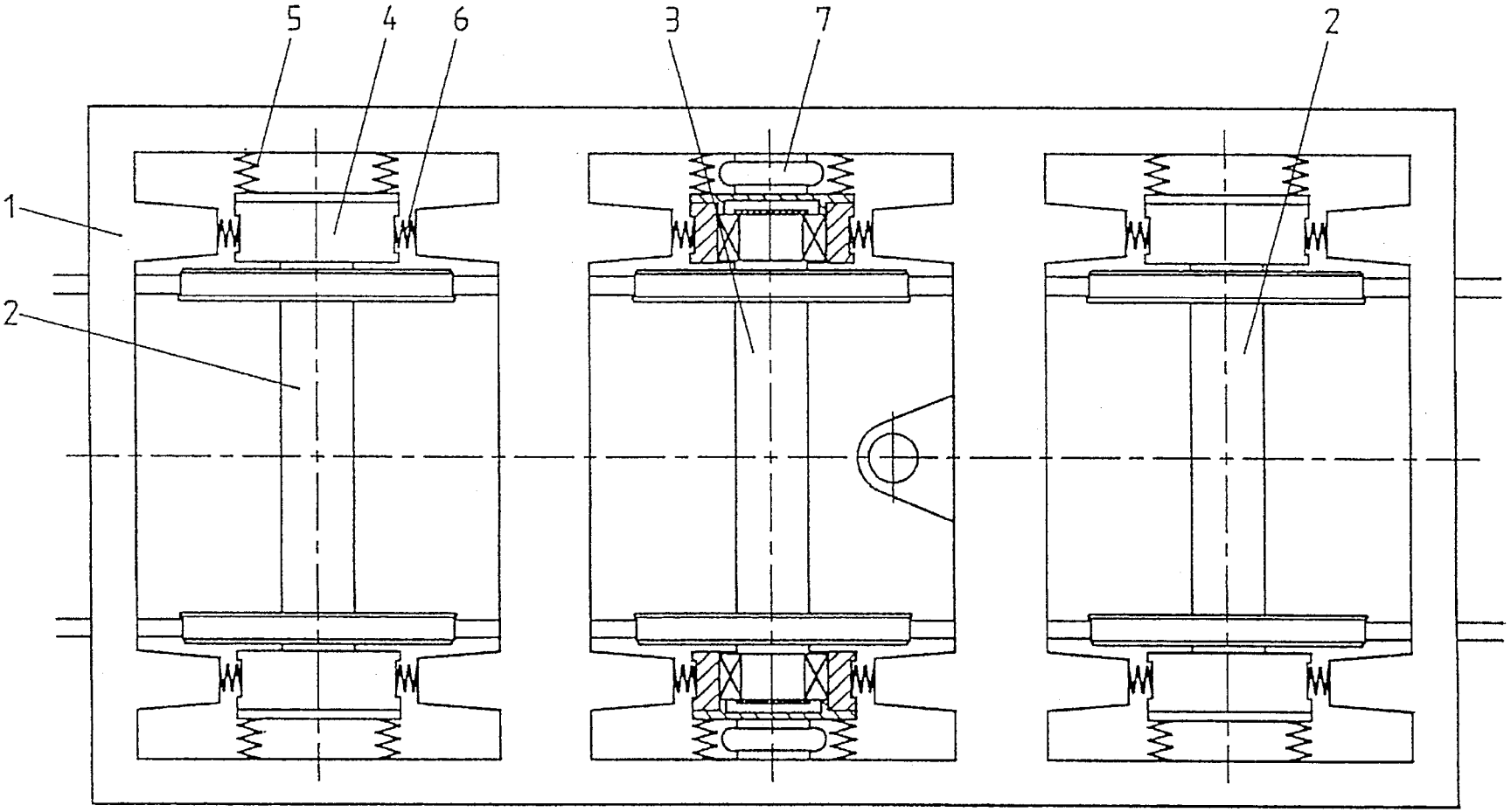
FIG. 1 shows a truck frame having three wheelsets and a lateral capturing of the middle wheelset with corresponding actuators.

In the embodiment illustrated in FIG. 1, the terminal wheelsets 2 and the middle wheelset 3 are each preferably coupled to the truck frame 1 by means of corresponding longitudinal guides 6 and lateral guides 5 which can be attached to the wheelset bearing 4. For purposes of clarity, vertical coupling elements and other equipment (brakes, motor, etc.),are not illustrated in any greater detail.

Thus, essentially, in FIG. 1, the wheelsets of one truck are shown. Wheelsets 2 represent terminal wheelsets, that is, wheelsets which flank middle wheelset 3.

On the middle wheelset 3, the lateral guides 5 on both sides plus the actuators 7 are preferably connected in parallel. In this embodiment, bellows-type air spring cylinders have been selected as the actuators 7, and are preferably unpressurized when the vehicle travels in straight sections of track. When the vehicle travels through a curve, the inside bellows-type air spring cylinder 7 of the wheelset 3 is pressurized by compressed air, and thereby provides the necessary force to push the middle wheelset 3 outward. Of course, actuators other than bellows-type air spring cylinders 7, such as pneumatic cylinders and hydraulic cylinders, can also be used.

Figure 1A:
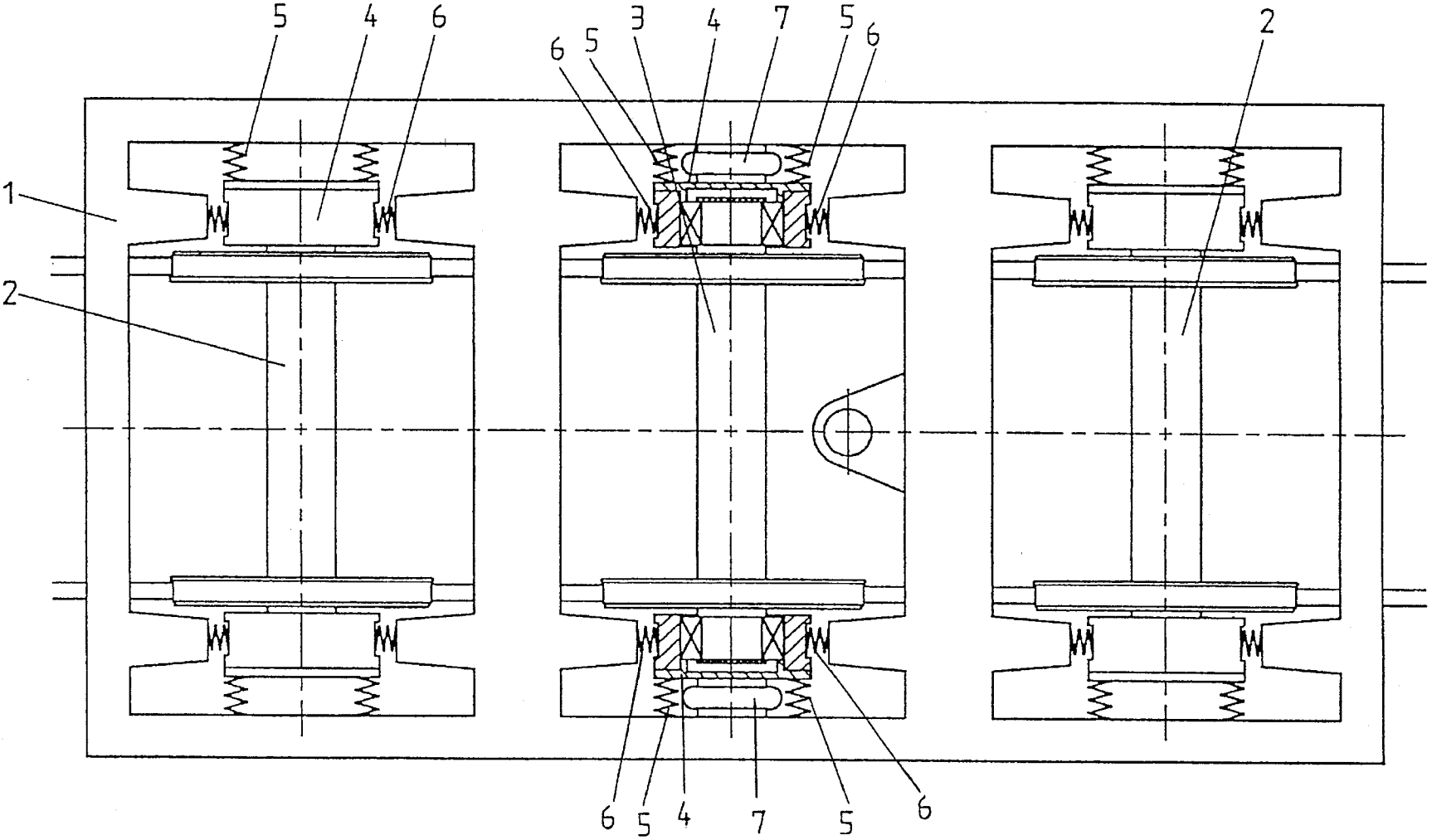
FIG. 1*a* is substantially the same view as FIG. 1, but more detailed.

In accordance with a preferred embodiment of the present invention, as shown in FIG. 1*a*, there is preferably one actuator 7 disposed on either lateral side of middle wheelset 3. As such, the two actuators 7 preferably act in tandem, that is, while one actuator 7 is pressurized to push on middle wheelset 3, the other actuator 7 is correspondingly depressurized to accept the lateral displacement of middle wheelset 3. Preferably, as shown in FIG. 1*a*, lateral guides 5 and longitudinal guides 6 are embodied by coil springs. Preferably, one coil spring 5 is placed on either side of, and in parallel with, each actuator 7. Preferably, on each side of each wheel bearing 4', there is a coil spring 6 oriented longitudinally.

Figure 2:
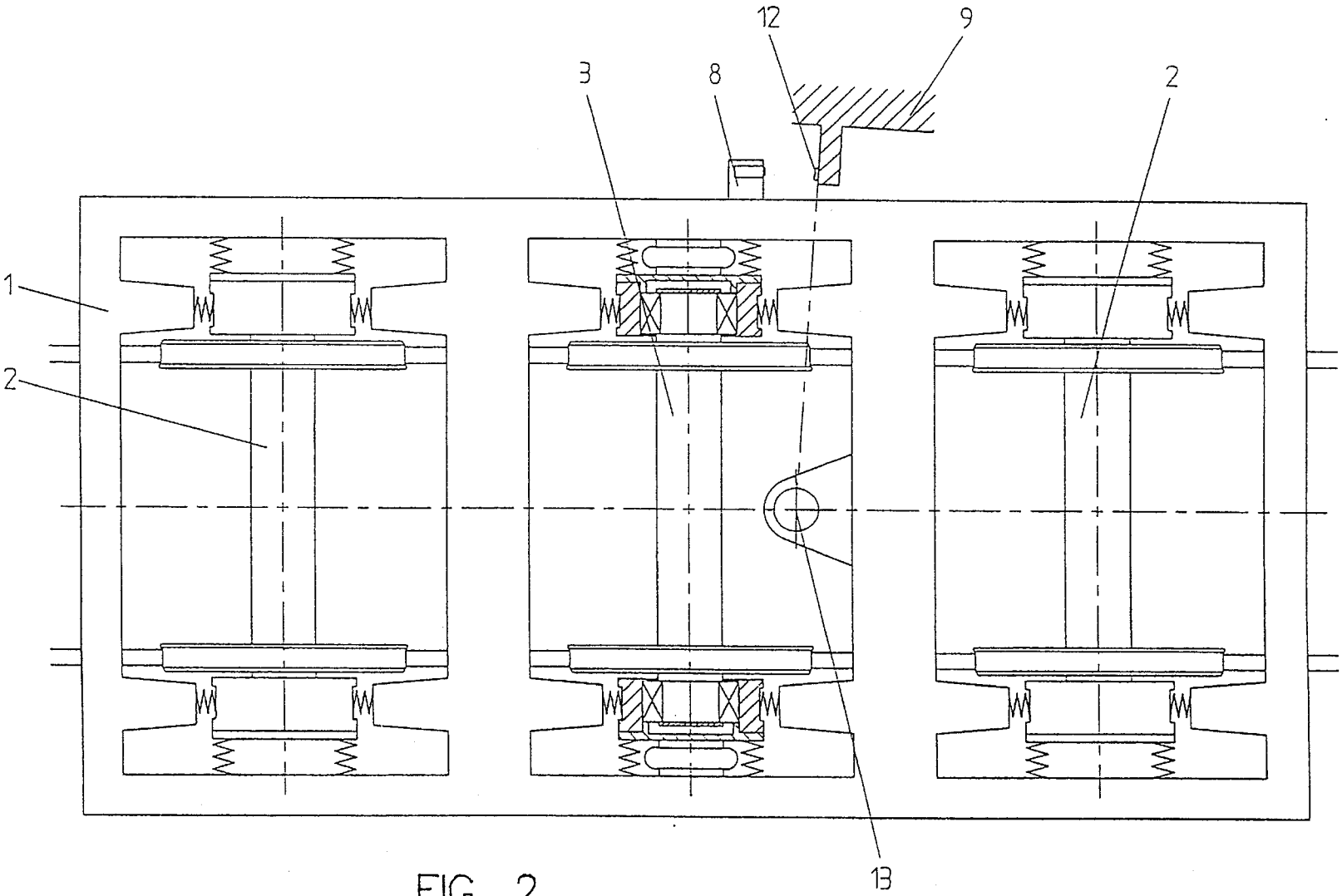
FIG. 2 shows the location of a sensor between the vehicle frame and the truck frame.

As illustrated in FIG. 2, the control unit to activate the bellows-type air spring cylinders 7 is preferably at least partly embodied by a sensor 8. The angle of rotation between the truck frame 1 and a schematically indicated vehicle frame 9 can preferably be determined from a measurement of the distance between the sensor 8 and a measurement surface 12 located on the vehicle frame 9, taking into consideration the lever arm at the pivoting center 13 of truck frame 1.

The angle is most appropriately, or efficiently, measured in the longitudinal direction, since the relative movement between the truck frame 1 and the vehicle frame 9 is generally less in the longitudinal direction than in the lateral direction.

Preferably, the sensor 8 shown in FIG. 2 may be an optical sensor for measuring the longitudinal distance between sensor 8 and measurement surface 12. The sensed distance may then preferably be calculated with respect to the angular displacement of the truck 3 with respect to the vehicle frame 9.

Of course, it is conceivable, within the scope of the present invention, to provide other types of sensor mechanisms. For example, it is conceivable to employ a sensor mechanism mounted in the vicinity of the pivoting connection, i.e. pivoting center 13, between vehicle frame 9 and truck frame 1, so that the rotational displacement of truck frame 1 with respect to vehicle frame 9 can be measured directly. Such a shaft mounted sensor mechanism may include, for example, a magnetic sensor, a capacitive sensor or an optical sensor.

Figure 3:
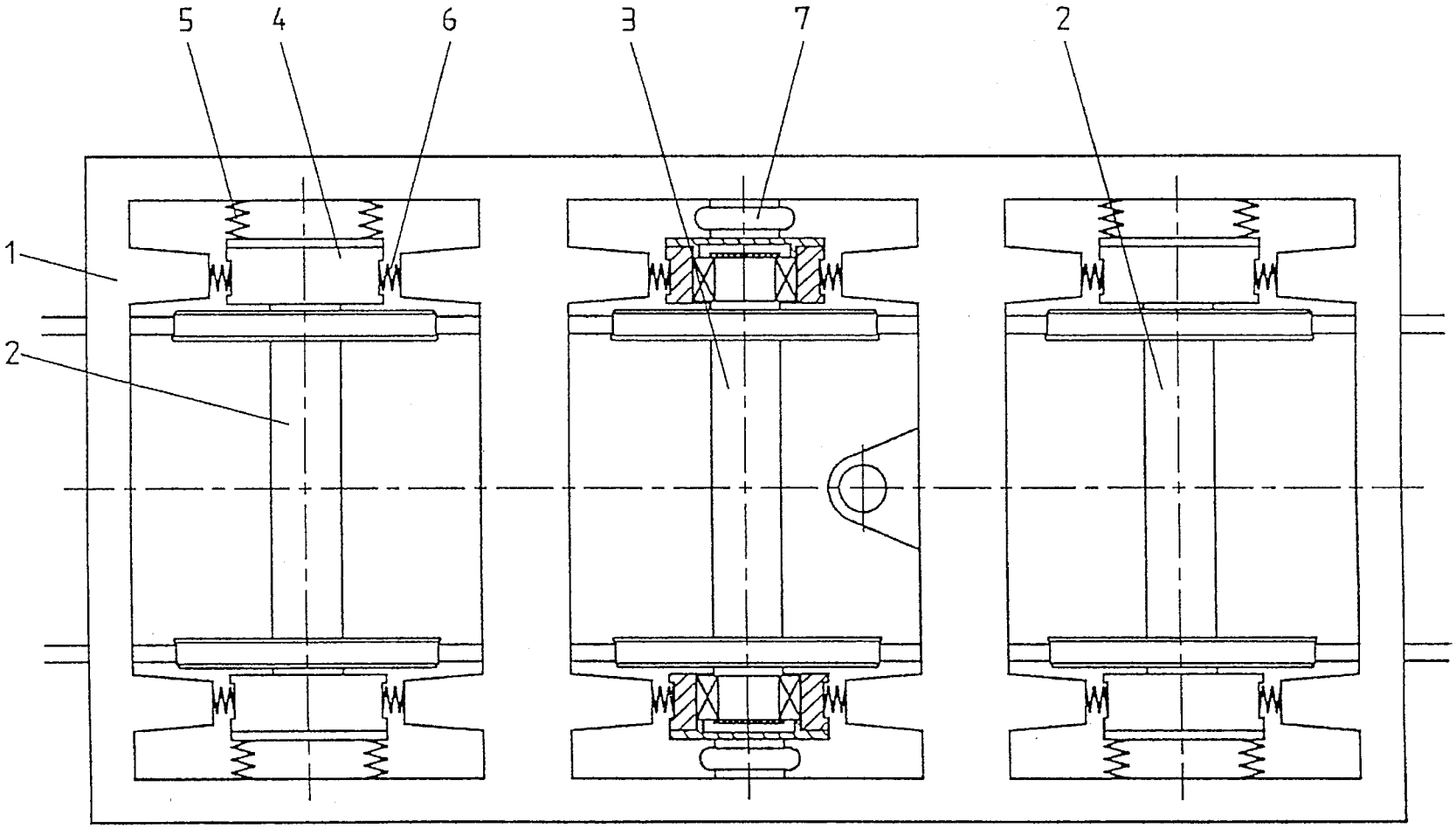
FIG. 3 shows an additional embodiment of a three-axle running gear with actuators for the simultaneous lateral guidance of a middle wheelset.

FIG. 3 illustrates an additional embodiment, in which the actuators 7 on the middle wheelset 3 simultaneously serve a suspension function in the lateral direction, and are capable of guiding the wheelset 3.

Thus, in accordance with an alternative embodiment of the present invention, as shown in FIG. 3, actuators 7 may preferably be configured to additionally serve as a lateral guide, or suspension, wherein the lateral guides 5 shown in FIGS. 1 and 1*a* would essentially not be needed.

When bellows-type air spring cylinders 7 are used, the aforementioned dual function can be accomplished by pressurizing the cylinders with compressed air even in their normal condition, and providing the required prestress. By reducing the pressure on one side or increasing the pressure on the other side, the required force can be exerted in the curve to achieve the required adjustment.

In other words, in accordance with a preferred embodiment of the present invention, when the bellows-type air spring cylinders 7 are prestressed as described above, further actuation of the cylinders 7 will essentially take place by either increasing the pressure level of the cylinder above the prestress level or decreasing the pressure level of the cylinder below the prestress level.

Figure 4:
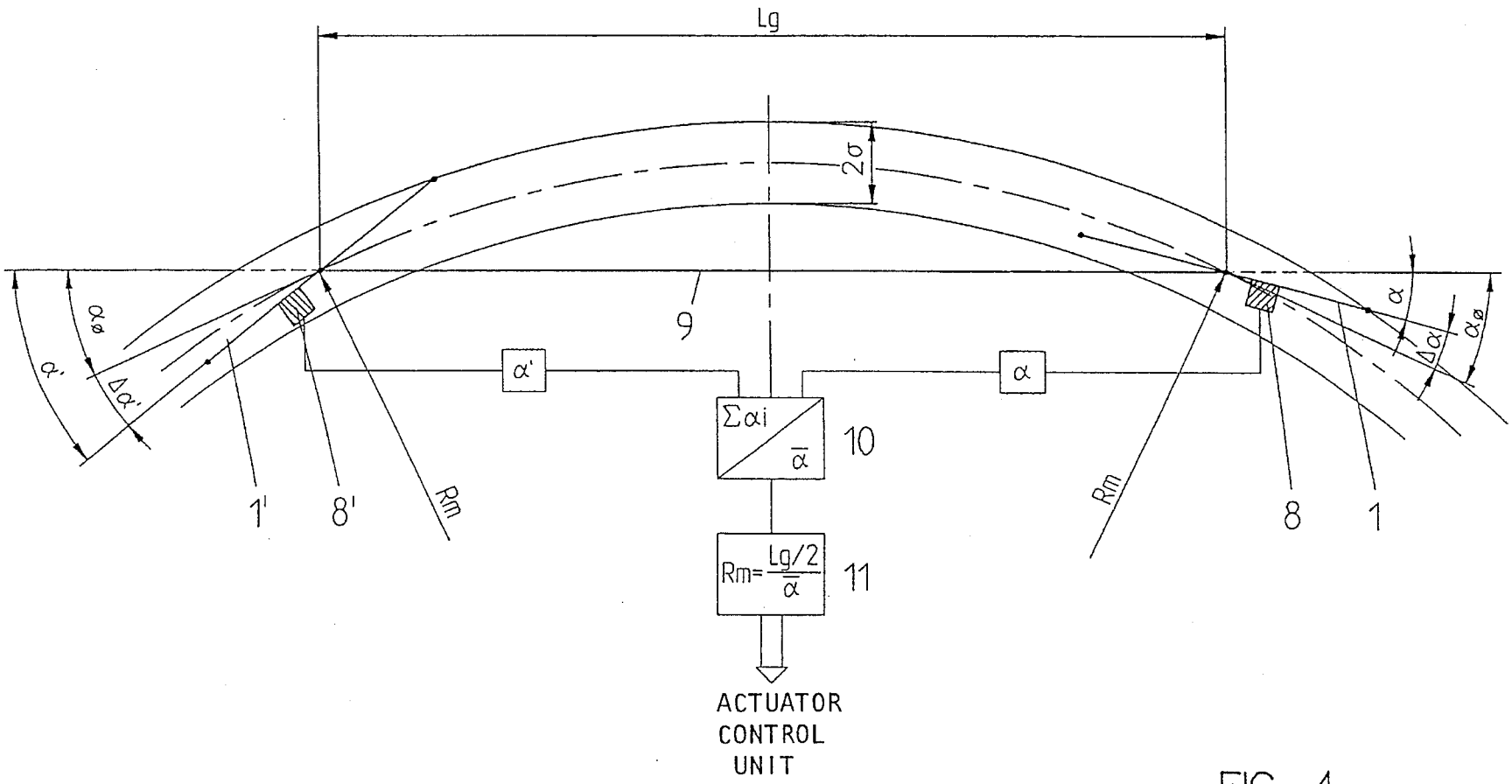
FIG. 4 shows a configuration of sensors on two trucks and the processing of the measurement signals.

FIG. 4 illustrates a configuration of two sensors 8 and 8' on truck frames 1, 1' located one behind the other, whereby there is a logic operation of the measurement signals generated when the railway vehicle is in the gauge channel of the railway.

The sensor 8 on the leading truck 1 and the sensor 8' on the trailing truck 1' each preferably calculate the respective angle of rotation ($\alpha$, $\alpha'$) of each truck 1, 1' in relation to the vehicle frame 9.

On account of the diagonal position, or inclination, inside the gauge channel 2 $\delta$ s and within the lateral compliance 2 $\delta Q$, the two angles $\alpha$ and $\alpha'$ may differ from the angle ($\alpha\phi$), which for trucks oriented radially gives:

$$\alpha\phi = \frac{lg/2}{Rm}$$

where 1*g* is the distance between trucks an Rm is the average curve radius.

FIG. 4 shows that the angle of rotation of the leading truck is somewhat less than $\alpha\phi$:

$$\alpha = \alpha\phi - \Delta\alpha$$

and that the angle of rotation of the trailing truck is somewhat greater:

$$\alpha' = \alpha\phi - \Delta\alpha'$$

Because $\Delta\alpha$ and $\Delta\alpha'$ are approximately the same, a very precise measurement for the radius of the curve through which the vehicle is travelling can be derived from the sum and/or the average of the two angles:

$$\alpha = \frac{\alpha + \alpha'}{2} \approx \alpha\phi = \frac{lg/2}{Rm}$$

The interconnection of the sensor output signals is also illustrated in FIG. 4. By summing or averaging 10, the two measurement signals can preferably be combined into a single value (alpha with a line over it) and converted into the curve radius by a computer 11. This processed value is now available for use as the setpoint in the control circuit of the actuators 7.

Figure 4A:
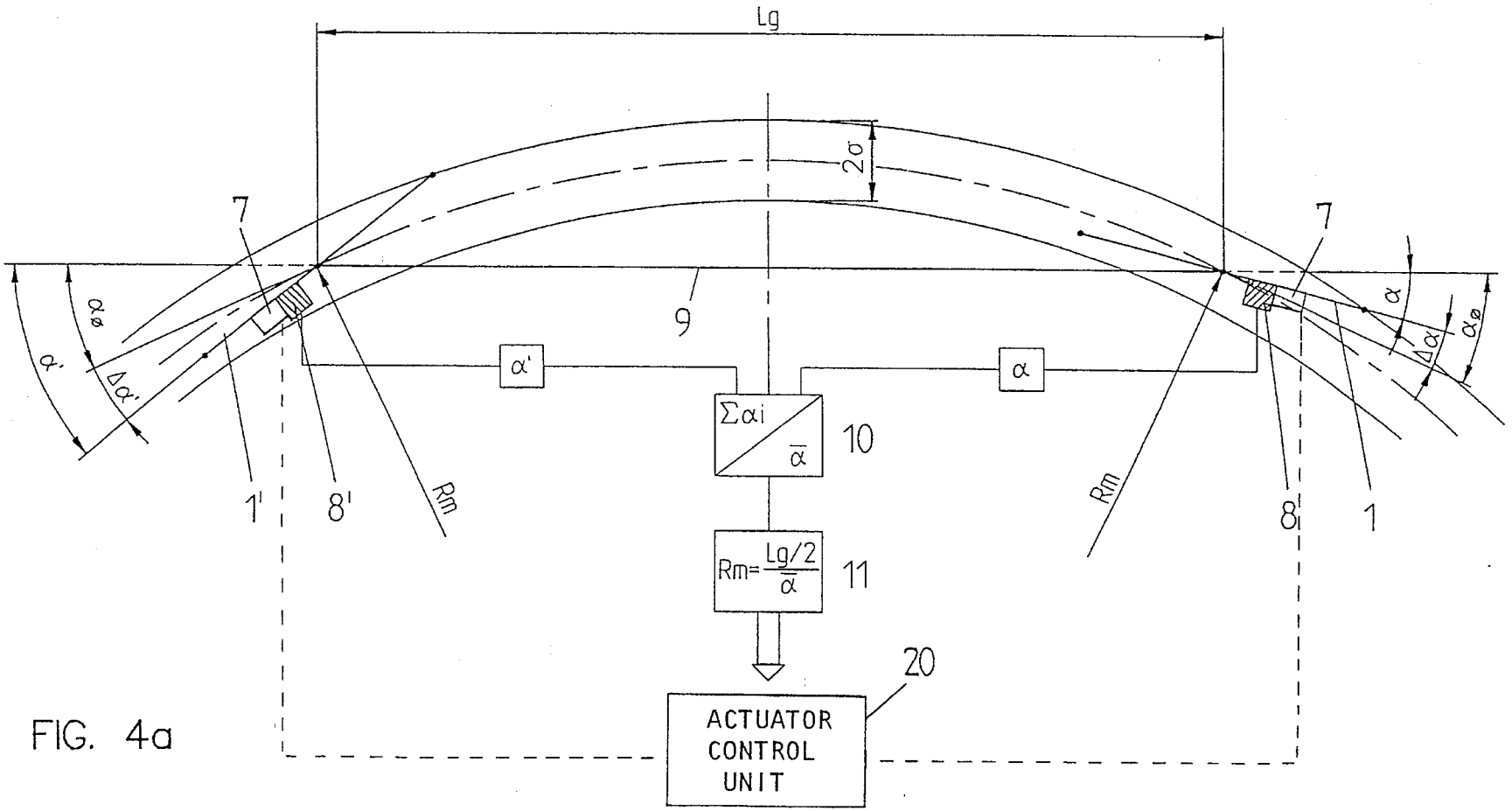
FIG. 4*a* is substantially the same view as FIG. 4, but more detailed.

FIG. 4*a* schematically illustrates a control system which may be employed in accordance with the present invention. Preferably, the determined value (11) for the curve radius Rm is fed into an actuator control unit 20. Preferably, the actuator control unit 20 controls the actuators 7 such that the actuator in question will provide the appropriate lateral displacement of the corresponding middle wheelset 3, as discussed previously. It is also conceivable, within the scope of the present invention, to provide separate control systems for the leading truck and the trailing truck, and to provide a system which would calculate an appropriate curve radius Rm for each of the leading truck and the trailing truck, based, respectively, on the angular displacement of each of the leading truck and the trailing truck with respect to the vehicle frame 9.

It should be understood that, within the scope of the present invention, it is conceivable to use the force-controlled actuators on wheelsets other than on middle wheelsets 3, such as on terminal wheelsets 2. Conceivably, the present invention could also be employed on trucks having a number of wheelsets other than three, such as on a truck having two wheelsets or on a truck having more than three wheelsets.

One feature of the invention resides broadly in the running gear for railway vehicles having at least six wheelsets, whereby each three wheelsets are connected by means of coupling and guide elements, in particular for longitudinal and lateral guidance, to a truck frame, and the truck frames can each turn in relation to a vehicle frame, characterized by the fact that on each side of the middle wheelset 3, between the truck frame 1 and the wheelset 3, there is a force-controlled actuator 7 acting in the lateral direction, which can be set to adjust the middle wheelset 3 during travel through curves toward the outside of the curve by means of a control unit, as a function of a measurement element 8 which measures the angle of rotation of the truck frame 1.

Another feature of the invention resides broadly in the running gear, characterized by the fact that the measurement element is a sensor 8 located between the vehicle frame 9 and the truck frame 1, and the actuators 7 can be adjusted as a function of the angle of rotation measured by the sensor 8.

Still another feature of the invention resides broadly in the running gear, characterized by the fact that the actuators 7 also apply a specified prestress for the lateral guidance of the wheelset 3.

Yet another feature of the invention resides broadly in the running gear, characterized by the fact that on each truck frame 1, 1' there is a sensor 8, 8', and the actuators 7, 7' can be set jointly by the control unit as a function of the average of the two angles of rotation.

Still yet another feature of the invention resides broadly in the running gear, characterized by the fact that the actuators are designed as bellows-type air spring cylinders 7.

Examples of actuator arrangements, such as bellows arrangements, pneumatic cylinder arrangements, and hydraulic cylinder arrangements, which may be utilized in accordance with the embodiments of the present invention, may be found in the following U.S. Patents: U.S. Pat. No. 5,141,412, which issued to Meinz on Aug. 25, 1992; U.S. Pat. No. 5,095,680, which issued to Guardiola on Mar. 17, 1992; U.S. Pat. No. 4,577,821, which issued to Edmo et al. on Mar. 25 1986; and U.S. Pat. No. 4,225,281, which issued to Bibeau et al on Sep. 30, 1980.

Examples of optical distance sensors, which may be utilized in accordance with the embodiments of the present invention, may be found in the following U.S. Patents: U.S. Pat. No. 5,151,608, which issued to Torii et al. on Sep. 29, 1992; U.S. Pat. No. 5,025,147, which issued to Durig et al. on Jun. 18, 1991; and U.S. Pat. No. 4,970,384, which issued to Kambe et al. on Nov. 13, 1990.

Examples of shaft-mounted sensors, which may be utilized in accordance with the embodiments of the present invention, may be found in the following U.S. Patents: U.S. Pat. No. 5,239,623, which issued to Iwata et al. on Aug. 24, 1993; U.S. Pat. No. 5,148,106, which issued to Ozawa on Sep. 15, 1992; U.S. Pat. No. 4,932,388, which issued to Chiba et al. on Jun. 12, 1990; and U.S. Pat. No. 4,931,636, which issued to Huggins on Jun. 5, 1990.

Examples of control systems, which may be utilized in accordance with the embodiments of the present invention, may be fund in the following U.S. Patents: U.S. Pat. No. 4,989,148, which issued to Gürke et al. on Jan. 29, 1991; U.S. Pat. No. 4,638,670, which issued to Moser on Jan. 27, 1987; U.S. Pat. No. 4,563,734, which issued to Mori et al. on Jan. 7, 1986; and U.S. Pat. No. 4,558,430, which issued to Mogami et af. on Dec. 10, 1985.

Federal Republic of Germany Laid-Open Patent Application No. DE-OS P 42 40 098, published on or about Jun. 3, 1994, having the title "Fahrwerk Für Schienfahrzeuge", having inventors Ernst Pees and Hans Dieter Schaller, and being assigned to Krupp Verkehrstechnik of D-24159 Kiel, Federal Republic of Germany; and copending U.S. patent application Ser. No. 08/157,943, which corresponds to the aforementioned German application and has the title "Bogie and Method of Operating a Bogie", are hereby incorporated by reference as if set forth in their entirety herein.

The components and methods of the various embodiments disclosed in Federal Republic of Germany Laid-Open, Patent Application No. DE-OS P 42 40 098 and copending U.S. patent application Ser. No. 08/157,943, may be combined with the components and methods of the various embodiments disclosed herein. For example, the apparatus for adjusting wheelsets, as disclosed in Federal Republic of Germany Laid-Open Patent Application No. DE-OS P 42 40 098 and copending U.S. patent application Ser. No. 08/157,943, may conceivably be used with at least terminal wheelsets 2 in the instant application, in conjunction with the use of apparatus for adjusting middle wheelset 3 in the instant application.

What is claimed is:

1. Railroad bogie for being mounted on a railroad car, such a railroad car having a frame and defining a longitudinal direction parallel to a direction of travel and a lateral direction perpendicular to the longitudinal direction, such a railroad car for being displayed on a railroad track, said railroad bogie comprising:

a frame element;

means for pivotally connecting said frame element to railroad car frame;

a first wheelset being mounted on said frame element;

a second wheelset being mounted on said frame element;

a third wheelset being mounted on said frame element;

said third wheelset being mounted on said frame element between said first wheelset and said second wheelset;

said third wheelset comprising:

an axle, said axle comprising opposite ends; and a pair of wheels being mounted at said opposite ends of said axle;

means for adjusting a position, in a direction parallel to the lateral direction of a railroad car, of said axle of said third wheelset with respect to said frame element during travel of a railroad car through a curved portion of railroad track;

said lateral adjusting means comprising means for laterally displacing said axle of said third wheelset;

means for sensing an angular position of said frame element with respect to a railroad car; and said lateral adjusting means comprising means for laterally displacing said axle of said third wheelset into a revised lateral position based on the sensed angular position of said frame element.

2. The railroad bogie according to claim 1, further comprising:

means for determining a revised lateral position of said axle of said third wheelset with respect to said frame element based on the angular position of said frame element with respect to a railroad car frame; and said means for laterally displacing said axle of said third wheelset into a revised lateral position comprising means for laterally displacing said axle of said third wheelset into the revised lateral position determined by said determining means.

3. The railroad bogie according to claim 2, wherein said lateral displacing means comprises force-controlled actuator means, said force-controlled actuator means being configured for providing a laterally directed force to laterally displace said axle of said third wheelset.

4. The railroad bogie according to claim 3, wherein:

said force-controlled actuator means is prestressed at a predetermined force;

said force-controlled actuator means comprises means for:

increasing the force of said force-controlled actuator means above the predetermined force to laterally displace said axle of said third wheelset in a first lateral direction; and decreasing the force of said force-controlled actuator means below the predetermined force to laterally displace said axle of said third wheelset in a second lateral direction, the second lateral direction being opposite the first lateral direction.

5. The railroad bogie according to claim 4, further comprising:

said force-controlled actuator means comprising bellow means, said bellow means being configured for expanding and contracting pneumatically and for thereby transferring a laterally directed force to said axle of said third wheelset;

said force-controlled actuator means comprising a first force-controlled actuator and a second force-controlled actuator, each of said first and second force-controlled actuators being connected with corresponding opposite ends of said axle of said third wheelset;

bearing means for bearing said wheels of each of said first wheelset, said second wheelset and said third wheelset;

each of said first and second force-controlled actuators comprising a bellows-type air spring cylinder;

said sensing means being disposed on said frame element;

said lateral adjusting means comprising control means for controlling said force-controlled actuator means;

each of said first and second wheelsets comprising:

an axle, said axle comprising opposite ends; and a pair of wheels being mounted at said opposite ends of said axle;

said bogie further comprising:

means for laterally guiding each of said first wheelset and said second wheelset with respect to said frame element; and means for longitudinally guiding each of said first wheelset, said second wheelset and said third wheelset with respect to said frame element;

said bearing means of each of said first wheelset, said second wheelset and said third wheelset comprising a bearing block for bearing a corresponding one of said opposite ends of said axle of each of said first wheelset, said second wheelset and said third wheelset;

each of said first and second force-controlled actuators being configured for laterally guiding said third wheelset with respect to said frame element;

said lateral guiding means comprising a plurality of coil springs connected between said frame element and said bearing means of each of said first wheelset and said second wheelset;

said longitudinal guiding means comprising a plurality of coil springs connected between said frame element and said bearing means of each of said first wheelset, said second wheelset and said third wheelset;

said plurality of coil springs of said lateral guiding means of each of said first and second wheelsets comprising:

first and second laterally oriented coil springs connected in parallel between one of said bearing blocks and said frame element; and third and fourth laterally oriented coil springs connected in parallel between the other of said bearing blocks and said frame element;

said plurality of coil springs of said longitudinal guiding means of each of said first, second and third wheelsets comprising:

first and second longitudinally oriented coil springs each being connected between a corresponding opposite side of one of said bearing blocks and said frame element; and third and fourth longitudinally oriented coil springs each being connected between a corresponding opposite side of the other of said bearing blocks and said frame element; said sensing means comprising optical sensing means;

said optical means comprising an optical sensor for sensing a straight-line distance, in the longitudinal direction of a railroad car, between said optical sensor and a measurement surface on a railroad car frame; and said means for determining a revised lateral position comprising means for converting the measured straight-line distance to an angular position of said frame element.

6. The railroad bogie according to claim 3, further comprising:

said force-controlled actuator means comprising bellow means, said bellow means being configured for expanding and contracting pneumatically and for thereby transferring a laterally directed force to said axle of said third wheelset;

said force-controlled actuator means comprising a first force-controlled actuator and a second force-controlled actuator, each of said first and second force-controlled actuators being connected with corresponding opposite ends of said axle of said third wheelset;

bearing means for bearing said wheels of each of said first wheelset, said second wheelset and said third wheelset;

each of said first and second force-controlled actuators comprising a bellows-type air spring cylinder;

said sensing means being disposed on said frame element;

said lateral adjusting means comprising control means for controlling said force-controlled actuator means;

each of said first and second wheelsets comprising:

an axle, said axle comprising opposite ends; and a pair of wheels being mounted at said opposite ends of said axle;

said bogie further comprising:

means for laterally guiding each of said first wheelset, said second wheelset and said third wheelset with respect to said frame element; and means for longitudinally guiding each of said first wheelset, said second wheelset and said third wheelset with respect to said frame element;

said bearing means of each of said first wheelset, said second wheelset and said third wheelset comprising a bearing block for bearing a corresponding one of said opposite ends of said axle of each of said first wheelset, said second wheelset and said third wheelset;

said lateral guiding means comprising a plurality of coil springs connected between said frame element and said bearing means of each of said first wheelset, said second wheelset and said third wheelset;

said longitudinal guiding means comprising a plurality of coil springs connected between said frame element and said bearing means of each of said first wheelset, said second wheelset and said third wheelset;

said plurality of coil springs of said lateral guiding means of each of said first, second and third wheelsets comprising:

first and second laterally oriented coil springs connected in parallel between one of said bearing blocks and said frame element; and third and fourth laterally oriented coil springs connected in parallel between the other of said bearing blocks and said frame element;

said first and second laterally oriented coil springs of said third wheelset flanking said first force-controlled actuator;

said third and fourth laterally oriented coil springs of said third wheelset flanking said second force-controlled actuator;

said plurality of coil springs of said longitudinal guiding means of each of said first, second and third wheelsets comprising:

first and second longitudinally oriented coil springs each being connected between a corresponding opposite side of one of said bearing blocks and said frame element; and third and fourth longitudinally oriented coil springs each being connected between a corresponding opposite side of the other of said bearing blocks and said frame element;

said sensing means comprising optical sensing means;

said optical means comprising an optical sensor for sensing a straight-line distance, in the longitudinal direction of a railroad car, between said optical sensor and a measurement surface on a railroad car frame; and said means for determining a revised lateral position comprising means for converting the measured straight-line distance to an angular position of said frame element.

7. Railroad bogie arrangement for being mounted on a railroad car, such a railroad car having a frame and defining a longitudinal direction parallel to a direction of travel and a lateral direction perpendicular to the longitudinal direction, such a railroad car for being displaced on a railroad track, said railroad bogie arrangement comprising:

a first bogie, said first bogie comprising:

a first frame element;

means for pivotally connecting said first frame element to a railroad car frame;

a first plurality of wheelsets being mounted on said first frame element;

each wheelset of said first plurality of wheelsets comprising:

an axle, said axle comprising opposite ends; and a pair of wheels being mounted at said opposite ends of said first axle;

said first plurality of wheelsets comprising:

a first wheelset being mounted on said first frame element;

a second wheelset being mounted on said first frame element; and a third wheelset being mounted on said first frame element;

said third wheelset being mounted on said first frame element between said first wheelset and said second wheelset;

first means for adjusting a position, in a direction parallel to the lateral direction of a railroad car, of said axle of said third wheelset with respect to said first frame element during travel; and means for sensing an angular position of said first frame element with respect to a railroad car;

a second bogie, said second bogie comprising:

a second frame element;

means for pivotally connecting said second frame element to a railroad car frame;

a second plurality of wheelsets being mounted on said second frame element;

each wheelset of said second plurality of wheelsets comprising:

an axle, said axle comprising opposite ends; and a pair of wheels being mounted at said opposite ends of said first axle;

said second plurality of wheelsets comprising:

a fourth wheelset being mounted on said second frame element;

a fifth wheelset being mounted on said second frame element; and a sixth wheelset being mounted on said second frame element;

said sixth wheelset being mounted on said second frame element between said fourth wheelset and said fifth wheelset;

second means for adjusting a position, in a direction parallel to the lateral direction of a railroad car, of said axle of said third wheelset with respect to said frame element during travel;

said second lateral displacing means comprises force-controlled actuator means, said force-controlled actuator means being configured for providing a laterally directed force to laterally displace said axle of said sixth wheelset; and means for sensing an angular position of said second frame element with respect to a railroad car;

said first lateral adjusting means comprising means for laterally displacing said axle of said third wheelset into a revised lateral position based on the sensed angular positions of said first and second frame elements; and said second lateral adjusting means comprising means for laterally displacing said axle of said sixth wheelset into a revised lateral position based on the sensed angular positions of said first and second frame elements.

8. The railroad bogie arrangement according to claim 7, further comprising:

means for determining:

a revised lateral position of said axle of said third wheelset with respect to said first frame element based on the angular position of said first frame element with respect to a railroad car frame; and a revised lateral position of said axle of said sixth wheelset with respect to said second frame element based on the angular position of said second frame element with respect a railroad car frame;

said means for laterally displacing said axle of said third wheelset into a revised lateral position comprising means for laterally displacing said axle of said third wheelset into the revised lateral position determined by said determining means; and said means for laterally displacing said axle of said sixth wheelset into a revised lateral position comprising means for laterally displacing said axle of said sixth wheelset into the revised lateral position determined by said determining means.

9. The railroad bogie arrangement according to claim 8, wherein:

said first lateral adjusting means comprises means for adjusting a position, in a direction parallel to the lateral direction of a railroad car, of said axle of said third wheelset with respect to said first frame element during travel of a railroad car through a curved portion of railroad track;

said first lateral adjusting means comprises means for laterally displacing said axle of said third wheelset;

said second lateral adjusting means comprises means for adjusting a position, in a direction parallel to the lateral direction of a railroad car, of said axle of said sixth wheelset with respect to said second frame element during travel of a railroad car through a curved portion of railroad track; and said second lateral adjusting means comprises means for laterally displacing said axle of said sixth wheelset.

10. The railroad bogie according to claim 9, wherein:

said first lateral displacing means comprises force-controlled actuator means, said force-controlled actuator means being configured for providing a laterally directed force to laterally displace said axle of said third wheelset; and said second lateral displacing means comprises force-controlled actuator means, said force-controlled actuator means being configured for providing a laterally directed force to laterally displace said axle of said sixth wheelset.

11. The railroad bogie arrangement according to claim 10, further comprising the following features with respect to said first bogie:

said force-controlled actuator means being prestressed at a predetermined force;

said force-controlled actuator means comprises means for:

increasing the force of said force-controlled actuator means above the predetermined force to laterally displace said axle of said third wheelset in a first lateral direction; and decreasing the force of said force-controlled actuator means below the predetermined force to laterally displace said axle of said third wheelset in a second lateral direction, the second lateral direction being opposite the first lateral direction;

said force-controlled actuator means comprising bellow means, said bellow means being configured for expanding and contracting pneumatically and for thereby transferring a laterally directed force to said axle of said third wheelset;

said force-controlled actuator means comprising a first force-controlled actuator and a second force-controlled actuator, each of said first and second force-controlled actuators being connected with corresponding opposite ends of said axle of said third wheelset;

bearing means for bearing said wheels of each of said first wheelset, said second wheelset and said third wheelset;

each of said first and second force-controlled actuators comprising a bellows-type air spring cylinder;

said sensing means being disposed on said first frame element;

said lateral adjusting means comprising control means for controlling said force-controlled actuator means;

each of said first and second wheelsets comprising:

an axle, said axle comprising opposite ends; and a pair of wheels being mounted at said opposite ends of said axle;

said first bogie further comprising:

means for laterally guiding each of said first wheelset and said second wheelset with respect to said first frame element; and means for longitudinally guiding each of said first wheelset, said second wheelset and said third wheelset with respect to said first frame element;

said bearing means of each of said first wheelset, said second wheelset and said third wheelset comprising a bearing block for bearing a corresponding one of said opposite ends of said axle of each of said first wheelset, said second wheelset and said third wheelset;

each of said first and second force-controlled actuators being configured for laterally guiding said third wheelset with respect to said first frame element;.

said lateral guiding means comprising a plurality of coil springs connected between said first frame element and said bearing means of each of said first wheelset and said second wheelset;

said longitudinal guiding means comprising a plurality of coil springs connected between said first frame element and said bearing means of each of said first wheelset, said second wheelset and said third wheelset;

said plurality of coil springs of said lateral guiding means of each of said first and second wheelsets comprising:

first and second laterally oriented coil springs connected in parallel between one of said bearing blocks and said first frame element; and third and fourth laterally oriented coil springs connected in parallel between the other of said bearing blocks and said first frame element;

said plurality of coil springs of said longitudinal guiding means of each of said first, second and third wheelsets comprising:

first and second longitudinally oriented coil springs each being connected between a corresponding opposite side of one of said bearing blocks and said first frame element; and third and fourth longitudinally oriented coil springs each being connected between a corresponding opposite side of the other of said bearing blocks and said first frame element;

said sensing means comprising optical sensing means;

said optical means comprising an optical sensor for sensing a straight-line distance, in the longitudinal direction of a railroad car, between said optical sensor and a measurement surface on a railroad car frame; and said means for determining a revised lateral position comprising means for converting the measured straight-line distance to an angular position of said first frame element.

12. The railroad bogie according to claim 10, further comprising the following features with respect to said first bogie:

said force-controlled actuator means comprising bellow means, said bellow means being configured for expanding and contracting pneumatically and for thereby transferring a laterally directed force to said axle of said third wheelset;

said force-controlled actuator means comprising a first force-controlled actuator and a second force-controlled actuator, each of said first and second force-controlled actuators being connected with corresponding opposite ends of said axle of said third wheelset;

bearing means for bearing said wheels of each of said first wheelset, said second wheelset and said third wheelset;

each of said first and second force-controlled actuators comprising a bellows-type air spring cylinder;

said sensing means being disposed on said first frame element;

said lateral adjusting means comprising control means for controlling said force-controlled actuator means;

each of said first and second wheelsets comprising:

an axle, said axle comprising opposite ends; and a pair of wheels being mounted at said opposite ends of said axle;

said first bogie further comprising:

means for laterally guiding each of said first wheelset, said second wheelset and said third wheelset with respect to said first frame element; and means for longitudinally guiding each of said first wheelset, said second wheelset and said third wheelset with respect to said first frame element;

said bearing means of each of said first wheelset, said second wheelset and said third wheelset comprising a bearing block for bearing a corresponding one of said opposite ends of said axle of each of said first wheelset, said second wheelset and said third wheelset;

said lateral guiding means comprising a plurality of coil springs connected between said first frame element and said bearing means of each of said first wheelset, said second wheelset and said third wheelset;

said longitudinal guiding means comprising a plurality of coil springs connected between said first frame element and said bearing means of each of said first wheelset, said second wheelset and said third wheelset;

said plurality of coil springs of said lateral guiding means of each of said first, second and third wheelsets comprising:

first and second laterally oriented coil springs connected in parallel between one of said bearing blocks and said first frame element; and third and fourth laterally oriented coil springs connected in parallel between the other of said bearing blocks and said first frame element;

said first and second laterally oriented coil springs of said third wheelset flanking said first force-controlled actuator;

said third and fourth laterally oriented coil springs of said third wheelset flanking said second force-controlled actuator;

said plurality of coil springs of said longitudinal guiding means of each of said first, second and third wheelsets comprising:

first and second longitudinally oriented coil springs each being connected between a corresponding opposite side of one of said bearing blocks and said first frame element; and third and fourth longitudinally oriented coil springs each being connected between a corresponding opposite side of the other of said bearing blocks and said first frame element;

said sensing means comprising optical sensing means;

said optical means comprising an optical sensor for sensing a straight-line distance, in the longitudinal direction of a railroad car, between said optical sensor and a measurement surface on a railroad car frame; and said means for determining a revised lateral position comprising means for converting the measured straight-line distance to the angular position of said first frame element.

13. Method of operating a railroad bogie on a railroad car, the railroad car having a frame and defining a longitudinal direction parallel to a direction of travel of the railroad car and a lateral direction perpendicular to the longitudinal direction, the railroad car for being displaced on a railroad track, said method comprising the steps of:

providing a frame element;

providing means for pivotally connecting the frame element to the frame of the railroad car;

providing at least one wheelset and mounting the at least one wheelset on the frame element, each of the at least one wheelset comprising an axle, the axle comprising opposite ends, each of the at least one wheelset comprising a pair of wheels being mounted at the opposite ends of the axle;

providing means for adjusting, in a direction parallel to the lateral direction of the railroad car, a position of at least one of the at least one wheelset with respect to the frame element during travel;

providing means for sensing an angular position of the frame element with respect to the frame of the railroad car;

providing means for determining a revised lateral position of the at least one of the at least one wheelset with respect to the frame element based on the angular position of the frame element with respect to the frame of the railroad car;

sensing an angular position of the frame element with respect to the frame of the railroad car;

determining a revised lateral position of the at least one of the at least one wheelset with respect to the frame element based on the angular position of the frame element with respect to the frame of the railroad car;

adjusting, in a direction parallel to the lateral direction of the railroad car, the position of the axle of each of the at least one of the at least one wheelset during travel.

14. The method according to claim 13, wherein:

said step of providing at least one wheelset comprises the steps of:

providing a first wheelset and mounting the first wheelset on the frame element;

providing a second wheelset and mounting the second wheelset on the frame element; and providing a third wheelset and mounting the third wheelset on the frame element between the first wheelset and the second wheelset;

said adjusting step comprising the step of adjusting, in a direction parallel to the lateral direction of the railroad car, a position of the axle of the third wheelset with respect to the frame element during travel.

15. The method according to claim 14, wherein:

said adjusting step comprises the step of adjusting, in a direction parallel to the lateral direction of the railroad car, a position of the axle of the third wheelset with respect to the frame element during travel of the railroad car through a curved portion of railroad track, such a curved portion of track having an outer rail and an inner rail, the outer rail being disposed away from a radial center of the curved portion of track and the inner rail being disposed towards the radial center of the curved portion of track.

16. The method according to claim 15, wherein:

said adjusting step comprises the step of laterally displacing the axle of the third wheelset in a direction towards the outer rail of a curved portion of track.

17. The method according to claim 16, wherein said step of providing lateral displacing means comprises providing force-controlled actuator means, the force-controlled actuator means being configured for providing a laterally directed force to laterally displace the axle of the third wheelset.

18. The method according to claim 17, further comprising the steps of:

providing a second frame element, corresponding to a second railroad bogie, and pivotally connecting the second frame element to the frame of the railroad car;

providing means for sensing an angular position of the second frame element with respect to the frame of the railroad car;

said step of providing means for determining a revised lateral position of the third wheelset comprising the step of providing means for determining a revised lateral position of the third wheelset with respect to the first frame element based on both the angular position of the first frame element and the angular position of the second frame element with respect to the railroad car;

sensing an angular position of the second frame element with respect to the frame of the railroad car;

said step of determining a revised lateral position comprising the step of determining a revised lateral position based on the average of the angular position of the first frame element and the angular position of the second frame element with respect to the railroad car;

configuring the railroad bogie such that:

the force-controlled actuator means is prestressed at a predetermined force;

the force-controlled actuator means comprises means for:

increasing the force of the force-controlled actuator means above the predetermined force to laterally displace the axle of the third wheelset in a first lateral direction; and decreasing the force of the force-controlled actuator means below the predetermined force to laterally displace the axle of the third wheelset in a second lateral direction, the second lateral direction being opposite the first lateral direction;

the force-controlled actuator means comprises bellow means, the bellow means being configured for expanding and contracting pneumatically and for thereby transferring a laterally directed force to the axle of the third wheelset;

the force-controlled actuator means comprises a first force-controlled actuator and a second force-controlled actuator, each of the first and second force-controlled actuators being connected with corresponding opposite ends of the axle of the third wheelset;

the railroad bogie comprises bearing means for bearing the wheels of each of the first wheelset, the second wheelset and the third wheelset;

each of the first and second force-controlled actuators comprises a bellows-type air spring cylinder;

the sensing means is disposed on the first frame element;

the lateral adjusting means comprises control means for controlling the force-controlled actuator means;

each of the first and second wheelsets comprises:
an axle, the axle comprising opposite ends; and
a pair of wheels being mounted at the opposite ends of the axle;

the railroad bogie further comprises:
means for laterally guiding each of the first wheelset and the second wheelset with respect to the first frame element; and
means for longitudinally guiding each of the first wheelset, the second wheelset and the third wheelset with respect to the first frame element;

the bearing means of each of the first wheelset, the second wheelset and the third wheelset comprises a bearing block for bearing a corresponding one of the opposite ends of the axle of each of the first wheelset, the second wheelset and the third wheelset;

each of the first and second force-controlled actuators is configured for laterally guiding the third wheelset with respect to the first frame element;

the lateral guiding means comprises a plurality of coil springs connected between the first frame element and the bearing means of each of the first wheelset and the second wheelset;

the longitudinal guiding means comprises a plurality of coil springs connected between the first frame element and the bearing means of each of the first wheelset, the second wheelset and the third wheelset;

the plurality of coil springs of the lateral guiding means of each of the first and second wheelsets comprise:
first and second laterally oriented coil springs connected in parallel between one of the bearing blocks and the first frame element; and
third and fourth laterally oriented coil springs connected in parallel between the other of the bearing blocks and the first frame element;

the plurality of coil springs of the longitudinal guiding means of each of the first, second and third wheelsets comprise:
first and second longitudinally oriented coil springs each being connected between a corresponding opposite side of one of the bearing blocks and the first frame element; and
third and fourth longitudinally oriented coil springs each being connected between a corresponding opposite side of the other of the bearing blocks and the first frame element;

the sensing means comprises optical sensing means;

the optical means comprise an optical sensor for sensing a straight-line distance, in the longitudinal direction of the railroad car, between the optical sensor and a measurement surface on the frame of the railroad car; and the means for determining a revised lateral position comprises means for converting the measured straight-line distance to the angular position of the first frame element with respect to the frame of the railroad car.

19. The method according to claim 17, further comprising the steps of:

providing a second frame element, corresponding to a second railroad bogie, and pivotally connecting the second frame element to the frame of the railroad car;

providing means for sensing an angular position of the second frame element with respect to the frame of the railroad car;

said step of providing means for determining a revised lateral position of the third wheelset comprising the step of providing means for determining a revised lateral position of the third wheelset with respect to the first frame element based on both the angular position of the first frame element and the angular position of the second frame element with respect to the railroad car;

sensing an angular position of the second frame element with respect to the frame of the railroad car;

said step of determining a revised lateral position comprising the step of determining a revised lateral position based on the average of the angular position of the first frame element and the angular position of the second frame element with respect to the railroad car;

configuring the railroad bogie such that:

the force-controlled actuator means comprises bellow means, the bellow means being configured for expanding and contracting pneumatically and for thereby transferring a laterally directed force to the axle of the third wheelset;

the force-controlled actuator means comprises a first force-controlled actuator and a second force-controlled actuator, each of the first and second force-controlled actuators being connected with corresponding opposite ends of the axle of the third wheelset;

the railroad bogie comprises bearing means for bearing the wheels of each of the first wheelset, the second wheelset and the third wheelset;

each of the first and second force-controlled actuators comprises a bellows-type air spring cylinder;

the sensing means is disposed on the first frame element;

the lateral adjusting means comprises control means for controlling the force-controlled actuator means;

each of the first and second wheelsets comprise:
an axle, the axle comprising opposite ends; and
a pair of wheels being mounted at the opposite ends of the axle;

the railroad bogie further comprises:
means for laterally guiding each of the first wheelset, the second wheelset and the third wheelset with respect to the first frame element; and
means for longitudinally guiding each of the first wheelset, the second wheelset and the third wheelset with respect to the first frame element;

the bearing means of each of the first wheelset, the second wheelset and the third wheelset comprise a bearing block for bearing a corresponding one of the opposite ends of the axle of each of the first wheelset, the second wheelset and the third wheelset;

the lateral guiding means comprises a plurality of coil springs connected between the first frame element and the bearing means of each of the first wheelset, the second wheelset and the third wheelset;

the longitudinal guiding means comprise a plurality of coil springs connected between the first frame element and the bearing means of each of the first wheelset, the second wheelset and the third wheelset;

the plurality of coil springs of the lateral guiding means of each of the first, second and third wheelsets comprise:

first and second laterally oriented coil springs connected in parallel between one of the bearing blocks and the first frame element; and third and fourth laterally oriented coil springs connected in parallel between the other of the bearing blocks and the first frame element;

the first and second laterally oriented coil springs of the third wheelset flank the first force-controlled actuator;

the third and fourth laterally oriented coil springs of the third wheelset flank the second force-controlled actuator;

the plurality of coil springs of the longitudinal guiding means of each of the first, second and third wheelsets comprise:

first and second longitudinally oriented coil springs each being connected between a corresponding opposite side of one of the bearing blocks and the first frame element; and third and fourth longitudinally oriented coil springs each being connected between a corresponding opposite side of the other of the bearing blocks and the first frame element;

the sensing means comprises optical sensing means;

the optical means comprises an optical sensor for sensing a straight-line distance, in the longitudinal direction of the railroad car, between the optical sensor and a measurement surface on the frame of the railroad car; and the means for determining a revised lateral position comprises means for converting the measured straight-line distance to the angular position of the first frame element with respect to the frame of the railroad car.

* * * * *

UNITED STATES PATENT AND TRADEMARK OFFICE

CERTIFICATE OF CORRECTION

PATENT NO. : 5,488,910

DATED : February 6, 1996

INVENTOR(S) : Ernest PEES and Hans-Dieter SCHALLER

It is certified that error appears in the above-indentified patent and that said Letters Patent is hereby corrected as shown below:

In column 4, line 31, after 'bearing', delete " 4,' " and insert --4,--.

In column 5, line 54, in the equation, before the first occurrence of '=', delete "α" and insert --$\bar{\alpha}$--.

In column 7, line 9, after 'be', delete "fund" and insert --found--.

In column 7, line 14, after 'et', delete "af." and insert --al.--.

In column 7, line 43, Claim 1, after 'being', delete "displayed" and insert --displaced--.

In column 7, line 47, Claim 1, before 'railroad' insert --a--.

Signed and Sealed this

Twenty-eighth Day of January, 1997

*Attest:*

Bruce Lehman

BRUCE LEHMAN

*Attesting Officer*

*Commissioner of Patents and Trademarks*